US010702121B2

(12) United States Patent
Weilage et al.

(10) Patent No.: US 10,702,121 B2
(45) Date of Patent: Jul. 7, 2020

(54) CLEANING TOOL WITH REMOVABLE SOCK

(71) Applicant: Ecolab USA Inc., St. Paul, MN (US)

(72) Inventors: Hope Weilage, St. Paul, MN (US); Sarah Gilbertson, St. Paul, MN (US)

(73) Assignee: Ecolab USA Inc., St. Paul, MN (US)

( * ) Notice: Subject to any disclaimer, the term of this patent is extended or adjusted under 35 U.S.C. 154(b) by 508 days.

(21) Appl. No.: 15/434,607

(22) Filed: Feb. 16, 2017

(65) Prior Publication Data

US 2017/0231456 A1 Aug. 17, 2017

Related U.S. Application Data

(60) Provisional application No. 62/296,175, filed on Feb. 17, 2016.

(51) Int. Cl.

| | |
|---|---|
| ***B25G 1/02*** | (2006.01) |
| ***A46B 7/04*** | (2006.01) |
| ***A47L 13/44*** | (2006.01) |
| ***A47L 13/38*** | (2006.01) |
| ***A47L 13/255*** | (2006.01) |

(Continued)

(52) U.S. Cl.

CPC ..... *A47L 13/44* (2013.01); *A46B 7/042* (2013.01); *A47L 13/16* (2013.01); *A47L 13/255* (2013.01); *A47L 13/256* (2013.01); *A47L 13/38* (2013.01); *B25G 1/04* (2013.01); *B25G 1/102* (2013.01); *A46B 2200/3033* (2013.01)

(58) Field of Classification Search

CPC ..... A46B 5/0095; A46B 7/04; B25G 1/02

See application file for complete search history.

(56) References Cited

U.S. PATENT DOCUMENTS 1,600,388 A * 9/1926 Barker ..... A46B 17/06 15/142

2,820,236 A 1/1958 Crowther (Continued)

FOREIGN PATENT DOCUMENTS

EP 0 968 677 A2 1/2000

EP 1 938 738 A1 7/2008

(Continued)

OTHER PUBLICATIONS

Premium Grill Brush, https://www.weber.com/US/en/accessories/brushes/premium-grill-brush-1, printed Jun. 26, 2017.

(Continued)

*Primary Examiner* — Michael D Jennings

(74) *Attorney, Agent, or Firm* — Merchant & Gould P.C.

(57) ABSTRACT

A cleaning tool includes a shaft extending from a proximal end to a distal end, where the shaft has a handle at the proximal end and a tool head at the distal end; and a sock removably mountable on the tool head. The tool head may include a through hole, and the sock may include a fastener with a first coupling member and a second coupling member, where the first and second coupling members are constructed to align with and couple through the through hole on the tool head. Alternatively the tool head includes one or more coupling members and the sock includes one or more corresponding coupling members constructed align with and couple with the one or more coupling members on the tool head.

12 Claims, 19 Drawing Sheets

(51) Int. Cl.

| | |
|---|---|
| ***A47L 13/16*** | (2006.01) |
| ***A47L 13/256*** | (2006.01) |
| ***B25G 1/04*** | (2006.01) |
| ***B25G 1/10*** | (2006.01) |

(56) References Cited

U.S. PATENT DOCUMENTS

| | | | | |
|---|---|---|---|---|
| 4,823,427 | A | 4/1989 | Gibbs et al. | |
| 5,138,738 | A | 8/1992 | Nicholson | |
| 5,177,831 | A | 1/1993 | Wirth | |
| 5,426,810 | A | 6/1995 | Rones | |
| 6,023,810 | A | 2/2000 | Gessert | |
| 6,061,862 | A | 5/2000 | Whitaker | |
| 6,216,306 | B1 | 4/2001 | Esterson et al. | |
| 6,463,620 | B2 | 10/2002 | Busha | |
| 6,745,428 | B2 | 6/2004 | MacLean | |
| 6,966,094 | B1 | 11/2005 | Rigakos | |
| 7,264,413 | B2 | 9/2007 | Vosbikian et al. | |
| 7,478,453 | B1 | 1/2009 | Busshaus | |
| 7,841,039 | B1 | 11/2010 | Squire | |
| 7,874,020 | B1 | 1/2011 | Franklin | |
| 8,032,974 | B2 | 10/2011 | Carpenter | |
| 8,069,520 | B2 | 12/2011 | Mattucci et al. | |
| 8,220,103 | B1 | 7/2012 | Lewis | |
| 8,341,796 | B1 * | 1/2013 | Rhee | A47K 7/08 15/210.1 |
| 8,365,340 | B2 * | 2/2013 | Barstad | A46B 7/00 15/209.1 |
| 8,418,307 | B1 | 4/2013 | Rhee | |
| 8,671,500 | B2 | 3/2014 | Carlson et al. | |
| 8,763,616 | B2 * | 7/2014 | Koptis | A46B 11/001 134/184 |
| 8,938,844 | B1 | 1/2015 | James | |
| 9,210,993 | B2 | 12/2015 | Gonzalez et al. | |
| 9,648,862 | B1 * | 5/2017 | Lievano | A01M 7/005 |
| 9,764,458 | B1 * | 9/2017 | Resh | B25G 3/18 |
| 2005/0207820 | A1 | 9/2005 | Franczak et al. | |
| 2006/0168746 | A1 | 8/2006 | Guyuron et al. | |
| 2008/0028555 | A1 | 2/2008 | Pertner et al. | |
| 2008/0092314 | A1 | 4/2008 | Griffin | |
| 2009/0255075 | A1 | 10/2009 | Carlson et al. | |
| 2011/0056039 | A1 * | 3/2011 | Suzuki | B41F 35/00 15/210.1 |
| 2012/0079667 | A1 | 4/2012 | Ashner, II | |
| 2013/0031738 | A1 * | 2/2013 | Fukuzawa | A47L 13/38 15/231 |
| 2013/0233347 | A1 * | 9/2013 | Wang | A47L 17/08 134/6 |
| 2013/0305555 | A1 * | 11/2013 | Spector | F26B 19/00 34/95.1 |
| 2014/0137338 | A1 * | 5/2014 | Meinzer | B25F 1/02 7/116 |
| 2014/0137352 | A1 | 5/2014 | Golla et al. | |
| 2015/0239115 | A1 * | 8/2015 | Mouch | B25G 1/04 403/376 |

FOREIGN PATENT DOCUMENTS

| | | |
|---|---|---|
| EP | 2 233 055 A2 | 9/2010 |
| IE | 10159793 | 7/2003 |
| WO | 2007/057494 A1 | 5/2007 |
| WO | 2013134069 | 9/2013 |

OTHER PUBLICATIONS

International Search Report of Written Opinion, dated May 28, 2017 for PCT/US2017/018184.

Extended European Search Report for Application No. 17753842.8 dated Jul. 23, 2019.

* cited by examiner

CLEANING TOOL WITH REMOVABLE SOCK

CROSS REFERENCE TO RELATED APPLICATIONS

This application claims the benefit of U.S. Provisional Application No. 62/296,175, which is hereby incorporated by reference in its entirety.

FIELD

The present disclosure relates to cleaning tools with removable, replaceable and/or exchangeable socks.

BACKGROUND

Appliances in kitchens, and particularly commercial kitchens, can be challenging to clean. Appliances may have irregular shapes with many corners and crevices, narrow spaces, and multiple heating coils that need to be cleaned. Appliances may also be soiled with soils that are difficult to clean, such as baked-on or burned soil that includes grease, protein residue, and carbohydrate residue. The soil may also include wet grease and carbonized grease. When selecting cleaning tools, considerations of soil type, tool reach, and ergonomics may play a role. Some areas or soils may require different cleaning pads than others, with certain areas and soils requiring aggressive pads for cleaning. Due to soiling or wear of the pad in heavy use and the need to use different types of pads on different areas of the same appliance, the pads may need to be switched out frequently. It is against this background that the present disclosure is made.

SUMMARY

The cleaning tool of the present disclosure includes a shaft extending from a proximal end to a distal end, where the shaft has a handle at the proximal end and a tool head at the distal end; and a sock removably mountable on the tool head. The tool head may include a through hole, and the sock may include a fastener with a first coupling member and a second coupling member, where the first and second coupling members are constructed to align with and couple through the through hole on the tool head. According to an alternative aspect, the tool head includes one or more coupling members and the sock includes one or more corresponding coupling members constructed align with and couple with the one or more coupling members on the tool head.

BRIEF DESCRIPTION OF DRAWINGS

In the drawings, like items are identified by the same reference number or in some instances showing alternative embodiments, by the same reference number distinguished by a prime.

DETAILED DESCRIPTION

As used herein, the term "about" refers to variation in the numerical quantity that can occur, for example, through typical measuring procedures in the real world; through inadvertent error in these procedures; through differences in the manufacture, source, or material used to make the device; and the like. The term "about" also encompasses amounts that differ due to different equilibrium conditions for a composition resulting from a particular initial mixture. Whether or not modified by the term "about", the claims include equivalents to the quantities.

The term "sock" is used here broadly to refer to the removable portion of the cleaning tool that comes into contact with the surface being cleaned. A sock is understood to include material defining a cavity with a closed end and an open end such that a tool end can be inserted through the open end into the cavity of the sock.

The present disclosure relates to cleaning tools with a removable, replaceable and/or exchangeable sock or cleaning pad. In particular, the present disclosure provides for a cleaning tool with a shaft having a handle and a tool head, and a sock that can be removably attached to the tool head. The sock can be removed and cleaned when it becomes soiled, or can be discarded when it becomes worn, or can be exchanged with a different style sock or cleaning pad based on the type of surface or soil being cleaned.

Figure 1:
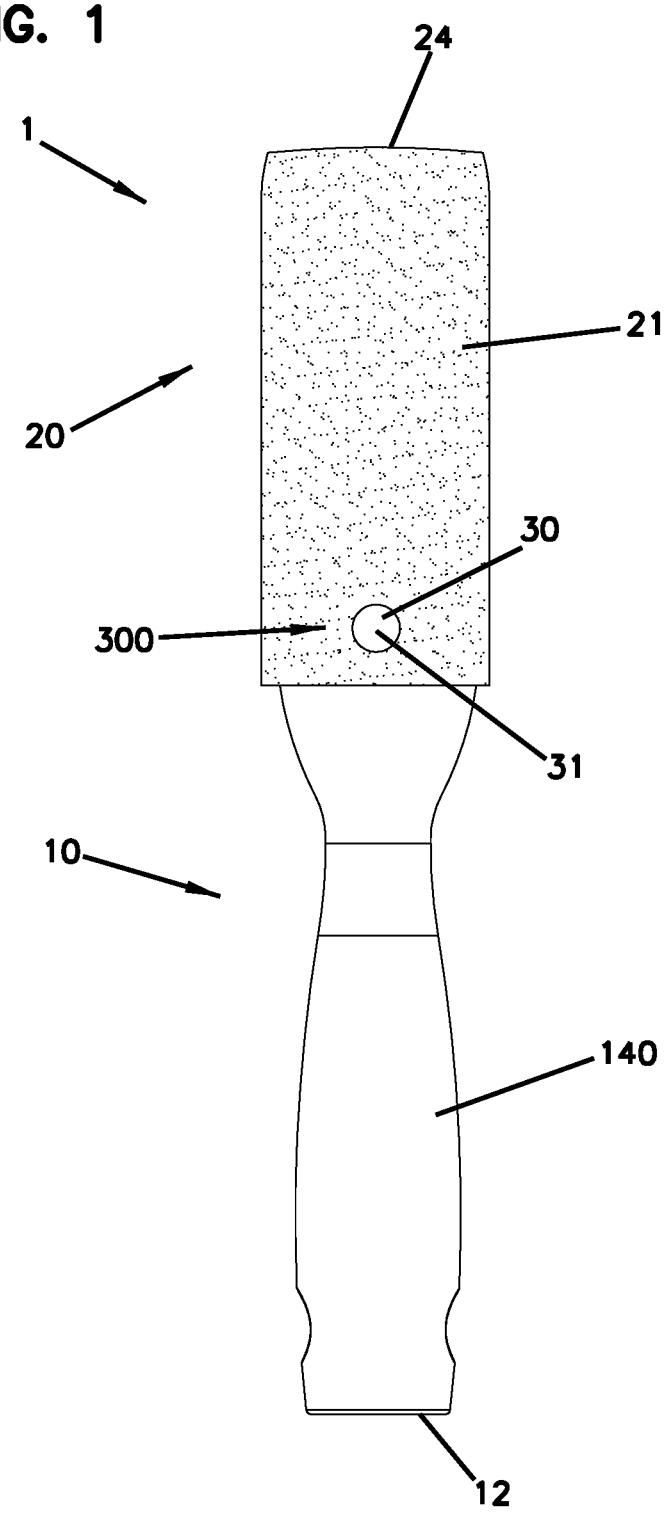
FIG. 1 is a schematic front view of a cleaning tool according to an embodiment.
Figure 2A:
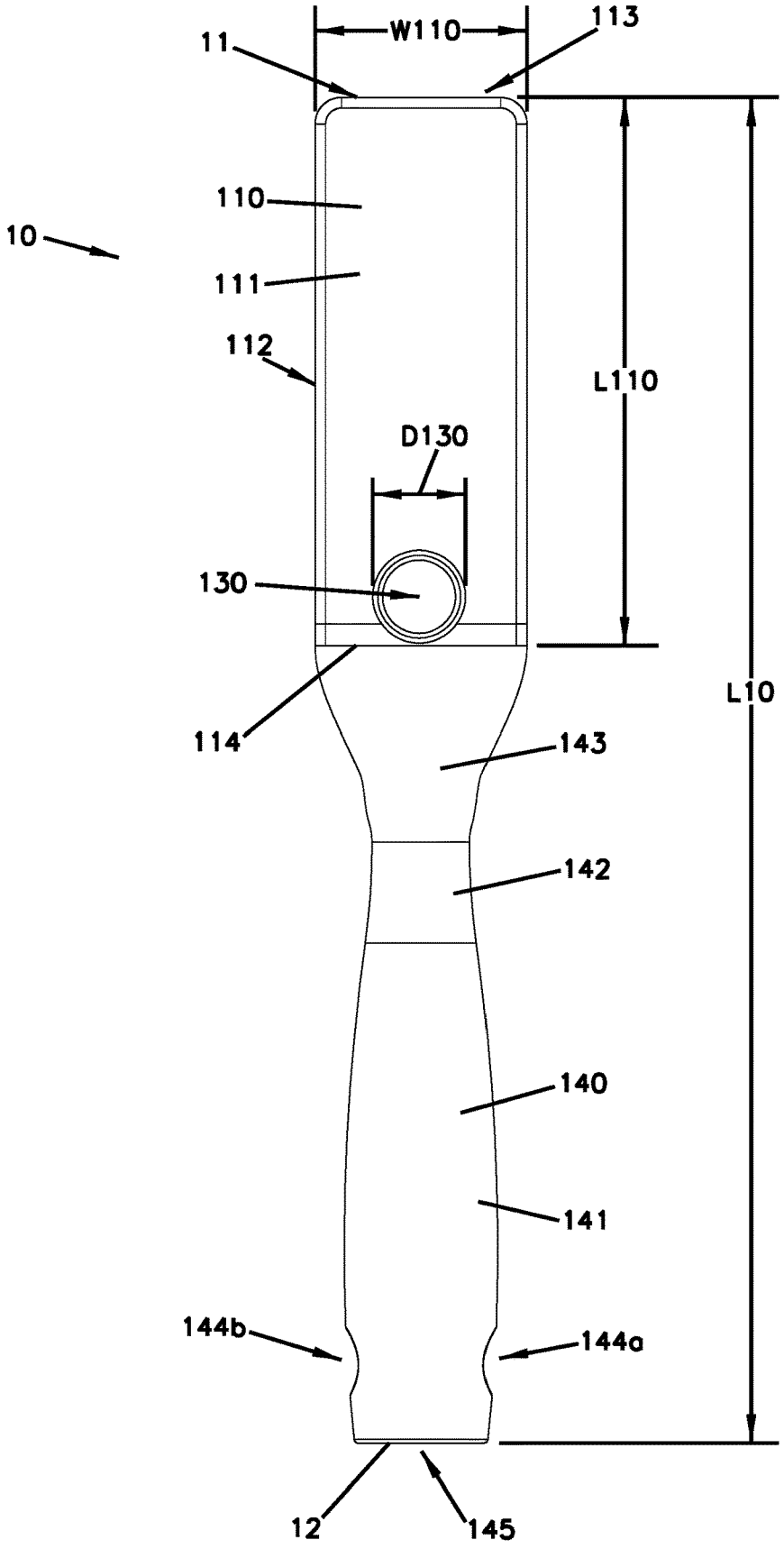
FIG. 2A is a front view of the shaft of the cleaning tool of FIG. 1.

An exemplary embodiment of the cleaning tool 1 is shown in FIG. 1. According to an embodiment, the cleaning tool 1 includes a shaft 10 and a removable sock 20. The shaft 10, shown in FIG. 2A, has a length L10 extending from a proximal end 12 to a distal end 11. The shaft 10 includes a handle 140 at the proximal end 12 and a tool head 110 at the distal end 11.

According to embodiments, the tool head 110 extends from a distal end of the handle 140. For example, the tool head 110 may extend from a neck 142 and/or a transition portion 143 of the handle 140. The handle 140 may have a round, semi-round, oval, oblong, square, rounded square, rectangle, rounded (and/or flattened) rectangle, or any other suitable transverse cross sectional shape. The neck 142 may comprise a narrowing portion of the handle 140, having a smaller cross dimension at the end connected to the tool head 110 than the gripping portion 141 of the handle 140, as shown in the exemplary embodiment in FIGS. 2B-2D. The transition portion 143 may be a funnel-like portion that transitions from the cross section of the handle 140 and/or the neck 142 to the cross section of the tool head 110. In the embodiments shown, the transition portion 143 provides a smooth transition from the handle 140 to the tool head 110 without sharp corners or edges.

The tool head 110 includes a first side 111 and a second side 112 opposite of the first side 111, where the first and second sides 111, 112 are major sides, and lateral sides 115, where the lateral sides 115 are minor sides. The first and second sides 111, 112 of the tool head 110 define a proximal end 114 adjacent the transition portion 143 and a distal end 113 opposite of the proximal end 114. The first and second sides 111, 112 may be disposed parallel to one another, and may be parallel to the longitudinal axis A of the shaft 10.

Figure 2B:
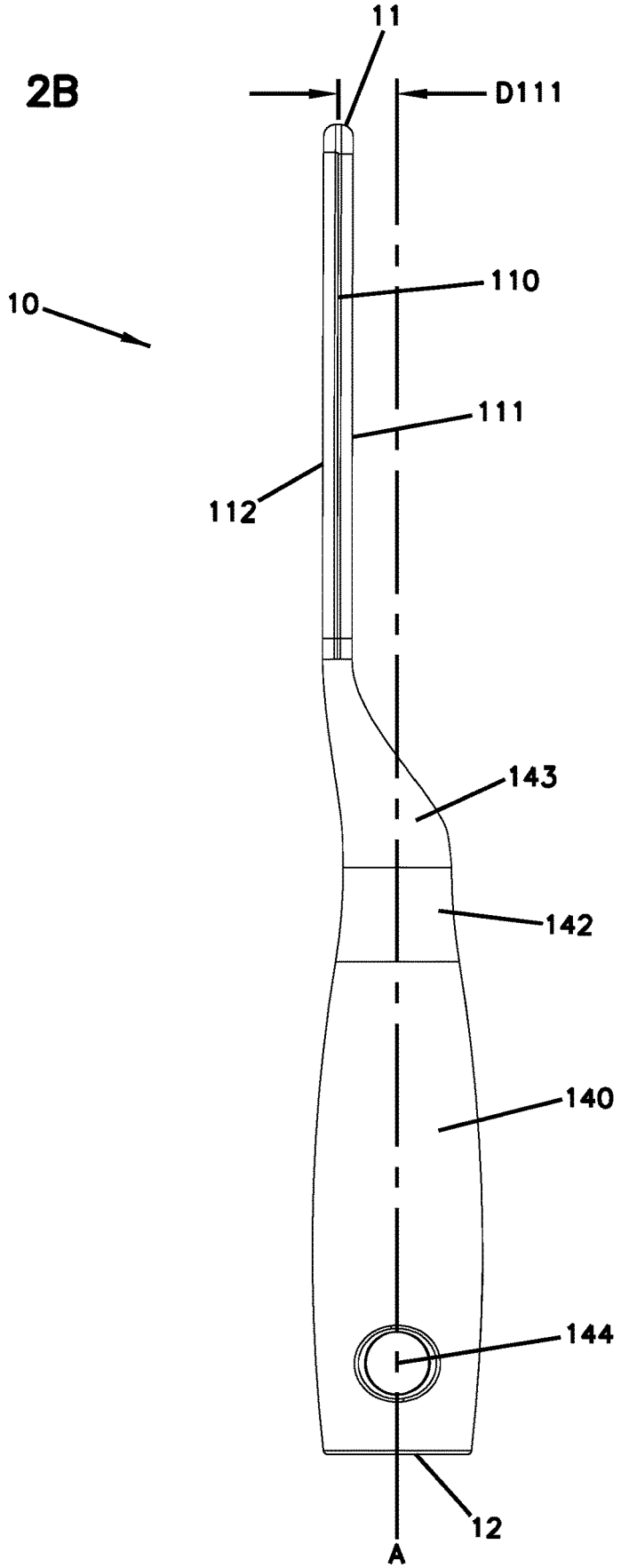
FIG. 2B is a side view of the shaft of the cleaning tool of FIG. 1.

The tool head 110 may be generally coaxially aligned with the central longitudinal axis A of the handle 140, or may be offset from the axis A. For example, the tool head 110 can be offset by a distance D111 from the axis A, as shown in FIG. 2B. In one embodiment, the distance D111 is about 0.2 to about 1 inch, or about 0.3 to about 0.75 inches. In one particular embodiment, the distance D111 is about 0.5 inches. In other embodiments, the offset may be greater to accommodate a more ergonomic design of the cleaning tool 1. For example, the distance D111 may be up to about 2 to about 3 inches.

In one embodiment, the tool head 110 is offset such that one or both of the flat surfaces (e.g., the first and/or second sides 111, 112) of the tool head 110 are parallel to the central axis A. In alternative embodiments, the tool head 110 may be disposed in an angle relative to the central axis A, or may be curved about an axis parallel to central axis A or about an axis transverse thereto. The orientation of the tool head 110 may be designed and constructed for a specific cleaning task or an appliance to be cleaned.

Figure 2C:
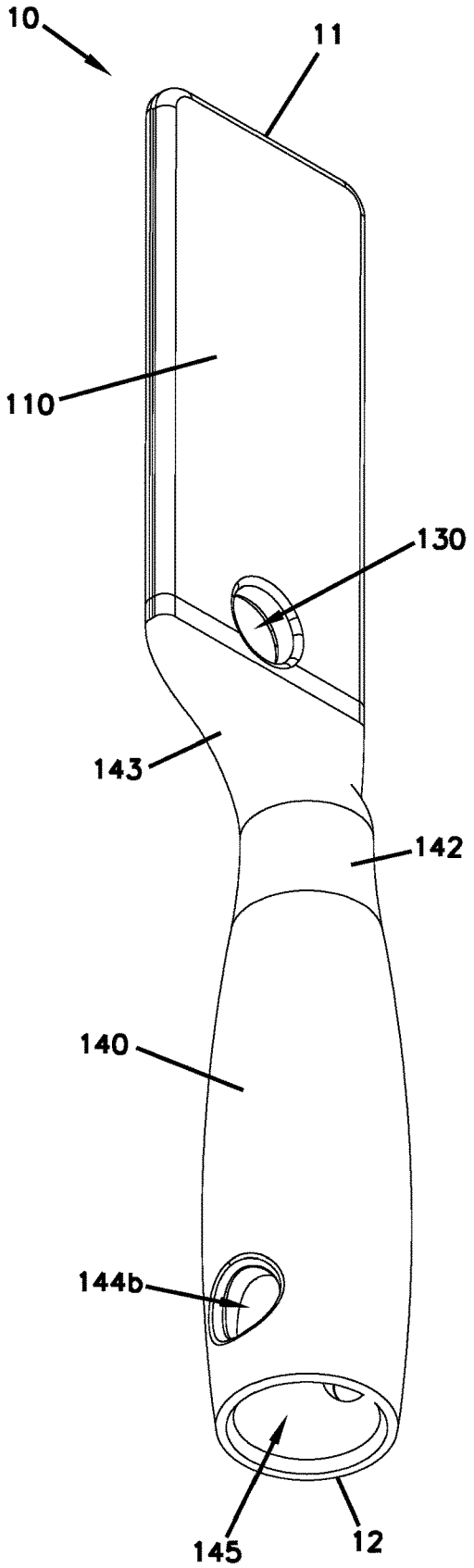
FIGS. 2C and 2D are perspective views of the shaft of the cleaning tool of FIG. 1.
Figure 2D:
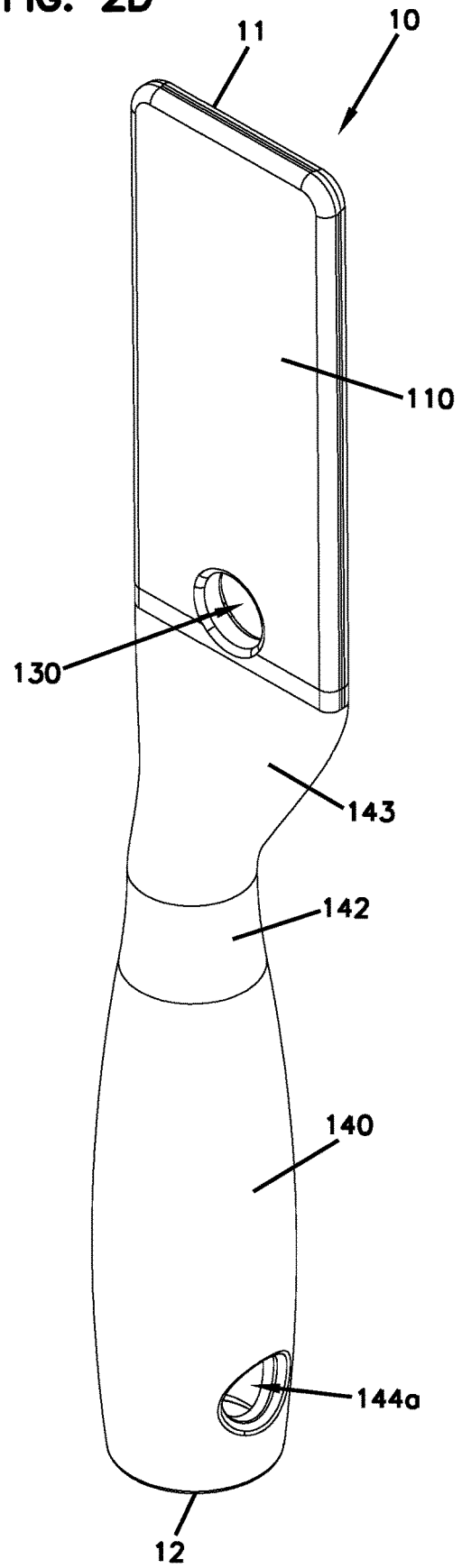

The tool head 110 may have an elongated shape extending from the transition portion 143. The tool head 110 may have an approximately rectangular shape, or any other suitable shape, such as oblong, oval, triangular, square, etc. The tool head 110 may have a generally flat transverse cross section (e.g., a flattened and/or rounded rectangle or oval), as shown in FIGS. 2B-2D. In alternative embodiments, the tool head 110 may have a more rounded cross section, such as an oblong, oval, or round cross section. The shape of the tool head 110 may be designed and constructed for a specific cleaning task or an appliance to be cleaned.

The cleaning tool 1 can be constructed for use as a universal cleaning tool with a tool head 110 having a size that is suitable for most cleaning applications. Alternatively, the cleaning tool 1 can be constructed for a specific cleaning application, such as for cleaning a specific appliance, e.g., a grill, a fryer, or a universal holding cabinet ("UHC"). The cleaning tool 1 can also be constructed so that it can be used either with or without an extension handle.

The tool head 110 may have any suitable size. For example, the tool head 110 may have a length L110 of about 2 to about 12 inches, about 2.5 to about 10 inches, or about 3 to about 8 inches. In one embodiment, the tool head 110 has a length L110 of about 3 to 4 inches. In another embodiment, the tool head 110 has a length L110 of about 4 to 5 inches. The tool head 110 may have a width W110 of about ¾ to about 6 inches, about 1 to about 4 inches, or about 1.25 to about 3 inches. The cleaning tool 1 can be constructed to be used to clean equipment that has narrow channels or spaces. For example, the cleaning tool 1 can be constructed with a tool head 110 that fits into narrow channels or spaces, where the tool head 110 has a width W110 of about 0.5 to about 2.5 inches, about 1.0 to about 2.25 inches, or about 1.25 to about 2.0 inches.

Figure 3A:
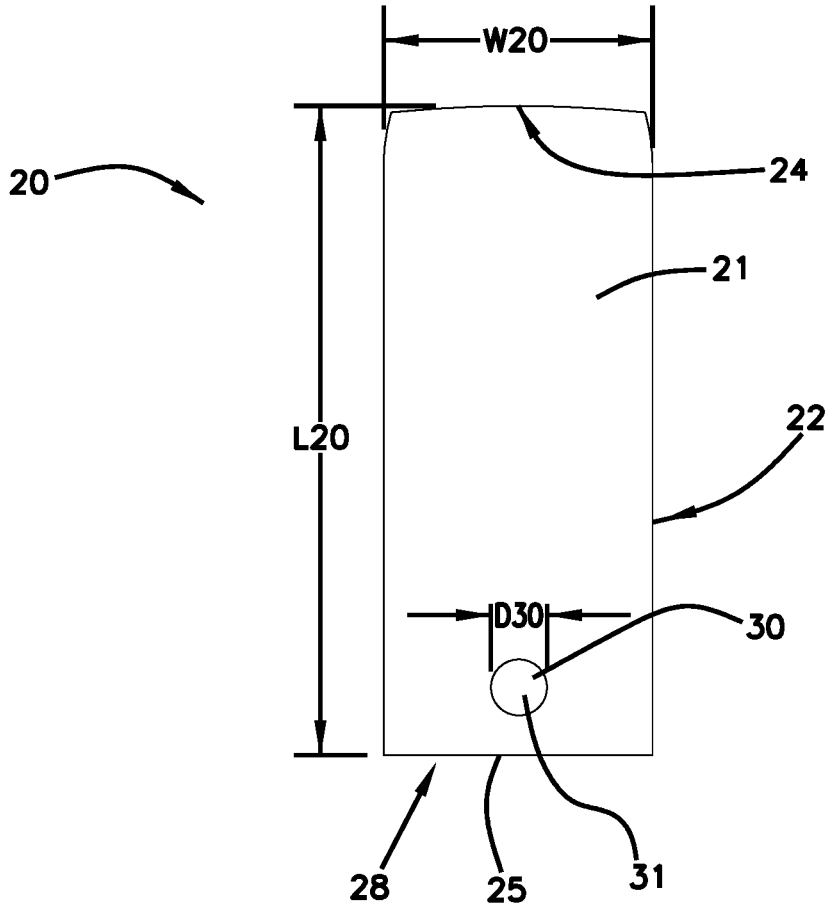
FIG. 3A is a schematic front view of a cleaning sock of the cleaning tool of FIG. 1.
Figure 3B:
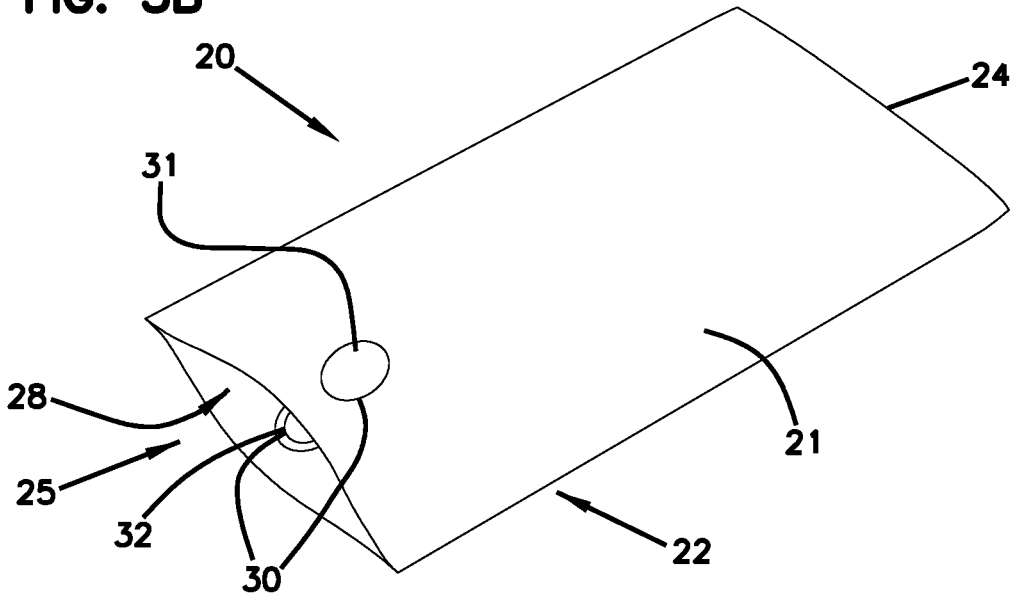
FIG. 3B is a schematic perspective view of the cleaning sock of FIG. 3A.

An exemplary embodiment of a sock 20 to be mounted on the tool head 110 is shown in FIGS. 3A and 3B. The sock 20 may have a tube-like or pocket-like construction comprising a first side 21 and a second side 22, where the first and second sides 21, 22 are attached along three edges (e.g., two lateral side edges and a top edge) with an opening 28 at the proximal end 25 of the sock 20. The sock 20 may alternatively have a tubular construction that does not have separate sides but rather a cylindrical body. The cylindrical body may be closed at the distal end of the sock 20.

The sock 20 has a width W20 and length L20 that approximately correspond to the width W110 and length L110 of the tool head 110 such that the sock 20 can be slidably mounted onto the tool head 110 by inserting the tool head 110 through the opening 28. In one embodiment, where the tool head 110 has a round transverse cross-sectional shape, the sock 20 has a circumference that fits around the tool head 110.

Figure 10:
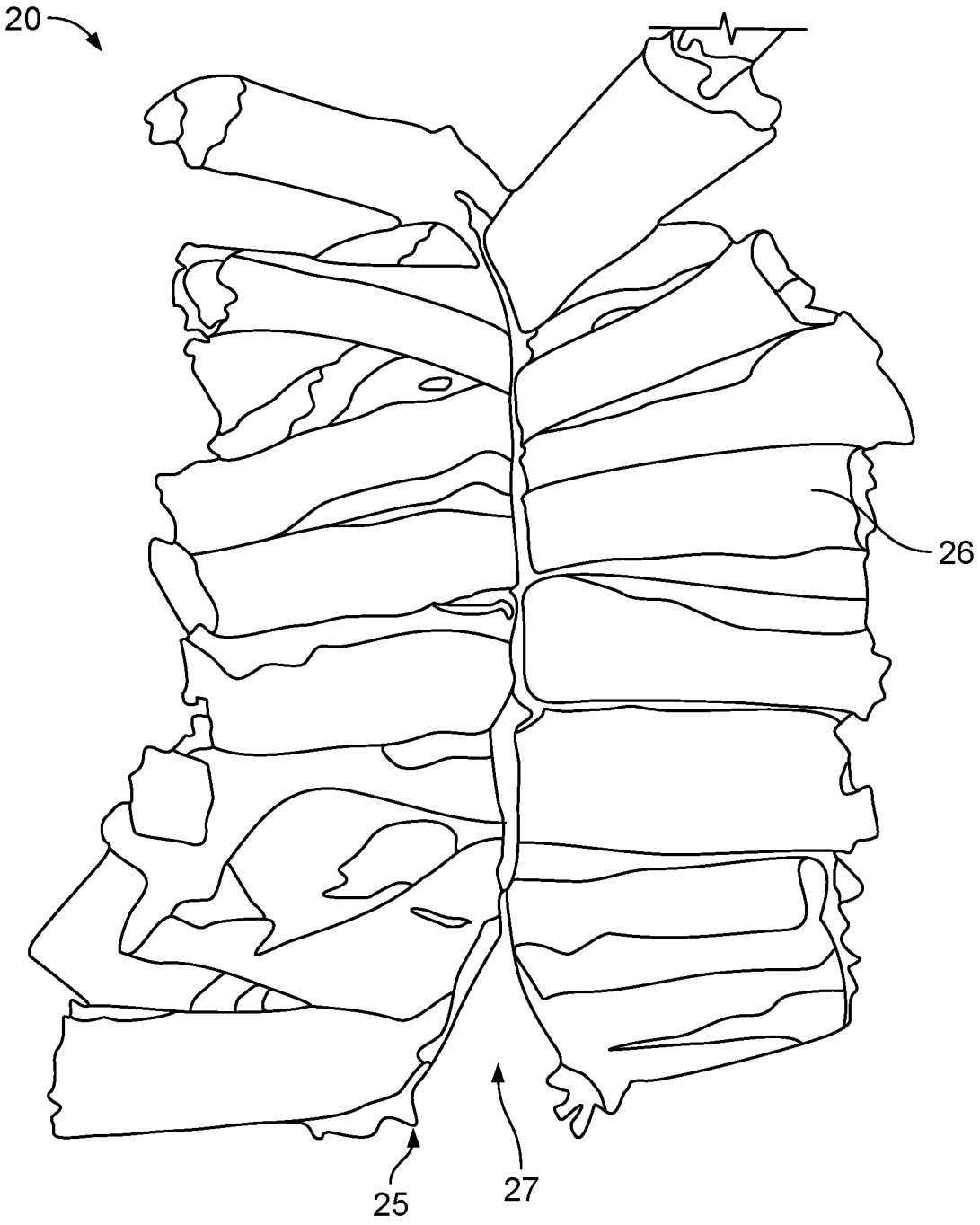
FIG. 10 is a photograph of another exemplary cleaning tool sock according to an embodiment.

The sock 20 may be provided with slits 27 or partial openings along the lateral side edges near the proximal end 25 to help with mounting and removing of the sock 20. The slits 27 may extend about 10%, about 15%, about 20%, about 25%, or up to about 50% of the length L20 of the sock 20 from the proximal end 25. In one exemplary embodiment shown in FIG. 10, the sock 20 has a length L20 of about 4 to about 5 inches, and includes a slit 27 on one or both lateral sides of the sock 20 extending about 1 to 2 inches from the opening at the proximal end of the sock 20.

The tool head 110 and the removable sock 20 can include a fastening mechanism 300, as shown in FIG. 1. The fastening mechanism 300 is constructed to retain the sock 20 on the tool head 110 when the sock 20 is mounted on the tool head 110 and when the cleaning tool 1 is in use. Further, the fastening mechanism 300 is constructed to be uncoupled so that the sock 20 can be removed.

The fastening mechanism 300 can comprise at least one fastener 30 on the sock 20 for fastening the sock 20 onto the tool head 110. The fastener 30 may, for example, include a first coupling member 31 and a second coupling member 32, as shown in FIG. 3B. The fastener 30 can comprise a snap closure, a hook-and-loop closure, a latch, a clasp, a button closure, a magnetic closure, or other suitable closure mechanism. The first coupling member 31 can be positioned on the first side 21 of the sock 20, and the second coupling member 32 on the second side 22. The first and second coupling members 31, 32 can be constructed to be coupled with each other, or with a coupling member on the tool head 110. Each of the first and second coupling member 3, 32 include a coupling side constructed to couple with a coupling side on a corresponding other coupling member either on the other side of the sock 20 or on the tool head 110. If the sock 20 is provided with one or more slits 27, the one or more slits 27 may extend from the proximal end 25 at least to or past the vertical position of the first and second coupling members 31, 32 along a longitudinal axis of the sock 20.

In the exemplary embodiment shown, the tool head 110 includes a through hole 130 that aligns with the fastener 30 on the sock 20 when the sock 20 is mounted on the tool head 110 and facilitates coupling of the first and second coupling members 31, 32. Although the fastening mechanism 300, including the through hole 130 and the fastener 30, is shown as a single button positioned approximately centered at the proximal end of the sock 20, the type, number, and location of the fastening mechanism 300 could vary and is not limited to the exemplary embodiment shown. For example, the cleaning tool 1 could include a plurality of fastening mechanisms 300, or the fastening mechanism(s) 300 could be positioned at different locations, such as off center, or on both sides of the center, or further away from the proximal end 25. A hook-and-loop fastening mechanism 300 could extend from one side edge of the sock 20 to the other side edge. The fastening mechanism 300 can also be positioned on or around the handle 140, such as the transition portion 143 or the neck 42. The fastening mechanism 300 could also have a different shape or size, for example in the event that the fastening mechanism 300 includes a hook-and-loop type closure. If the shaft 10 includes a through hole 130, the through hole 130 can be any suitable shape to accommodate the fastener 30 on the pad 20. For example, the through hole 130 can be round, oval, oblong, elongated, rectangular, etc.

In an alternative embodiment, the tool head 110 may include a coupling member that is constructed to couple with one or more coupling members on the sock 20. For example, if the fastening mechanism 300 includes snap buttons, the tool head 110 may include one half of a snap button and the sock 20 may include a mating half of the snap button as the first and/or second coupling member 31, 32. The tool head 110 may include a portion of the fastening mechanism (e.g., a half of a snap button, hook-and-loop closure, button closure, or magnetic closure) on both sides (e.g., first side 111 and second side 112) of the tool head 110. The mating halves of the fastening mechanism 300 can be arranged so that the sock 20 can be mounted on the tool head 110 with either side of the sock 20 (e.g., first side 21 or second side 22) facing the front of the cleaning tool 1.

In some embodiments, the cleaning tool 1 includes more than one fastening mechanism 300 for fastening the sock 20 to the tool head 110. The fasteners 30 on the sock 20 and the through holes 130 or other coupling members on the tool head 110 are positioned such that each fastener 30 aligns with a through hole 130 or other coupling member.

The tool head 110 can further be provided with a roughened surface on the first side 111 and/or the second side 112 to provide friction and to further help keep the sock 20 mounted on the tool head 110. For example, the tool head 110' can be constructed with a plurality of bumps 116 as shown in FIGS. 4A-4D and 5A-5D to provide friction. In the exemplary embodiment shown, the bumps 116 are positioned on both sides (first side 111 and second side 112) of the tool head 110. However, the bumps 116 may also be positioned on one side only (e.g., first side 111 or second side 112), and may be positioned throughout the surface, or in a limited area, such as in the center area 117A only (see FIG. 4F), in the distal area 117B only, on the sides 117C only, in the proximal area 117D only, or any combination thereof.

In one embodiment, the bumps 116 are absent from the proximal area 117D of the tool head 110' or the area near the through hole 130. In the exemplary embodiment shown in FIGS. 4A-4F, the bumps 116 extend from the proximal end 114 of the tool head 110' to approximately ¾ of the way toward the distal end 113. In the alternative embodiment in FIGS. 5A-5F, the bumps 116' extend substantially all the way from the area near the through hole 130 to the distal end 113 of the tool head.

The bumps 116 can have any suitable size and shape to help retain the sock 20 mounted on the tool head 110. For example, the bumps can be conical or pyramid-shaped having a cross diameter of about 0.5 to about 4 mm, about 1 to about 3 mm, or about 1.5 to about 2.5 mm, as shown in FIGS. 4A-4D. Or the bumps may be rectangular, as shown in FIGS. 5A-5D, having a length of about 2 to about 12 mm, or about 4 to 8 mm, and a width of about 0.5 to about 4 mm. The height of the bumps may be about 0.5 to about 4 mm, about 1 to about 3 mm, or about 1.5 to about 2.5 mm. The bumps may be distributed and/or oriented in any suitable arrangement or pattern, such as the exemplary grid patterns shown in FIGS. 4A and 5A. Combinations of various shapes, sizes, and patterns of bumps may also be used.

Figure 5A:
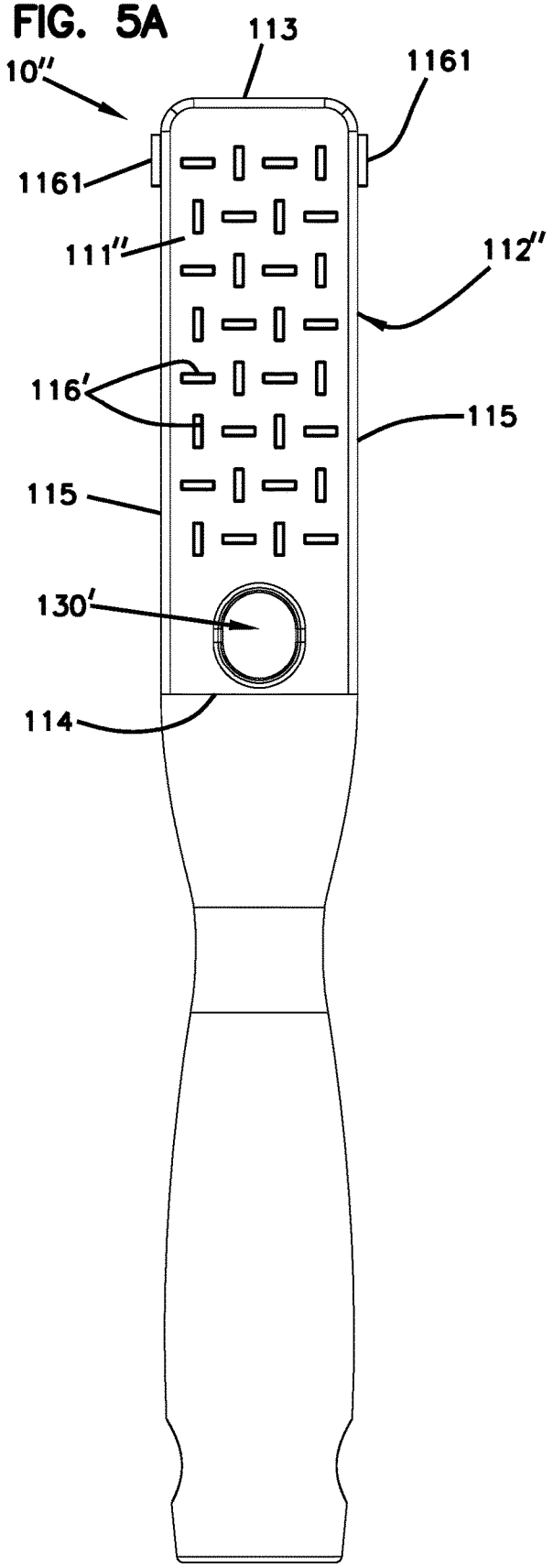
FIG. 5A is a front view of the shaft of a cleaning tool according to an embodiment.
Figure 5B:
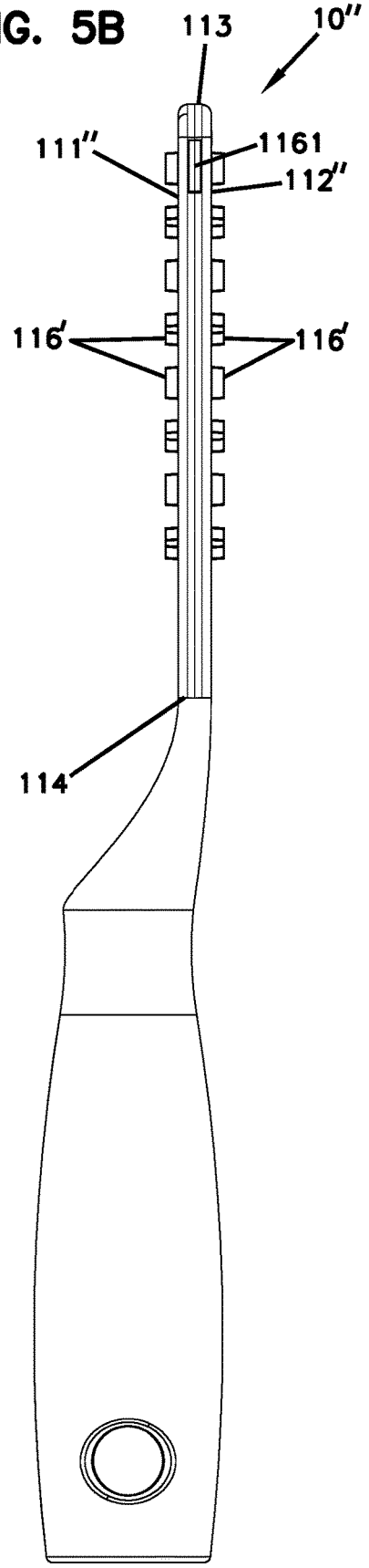
FIG. 5B is a side view of the shaft of the cleaning tool of FIG. 5A.
Figure 5C:
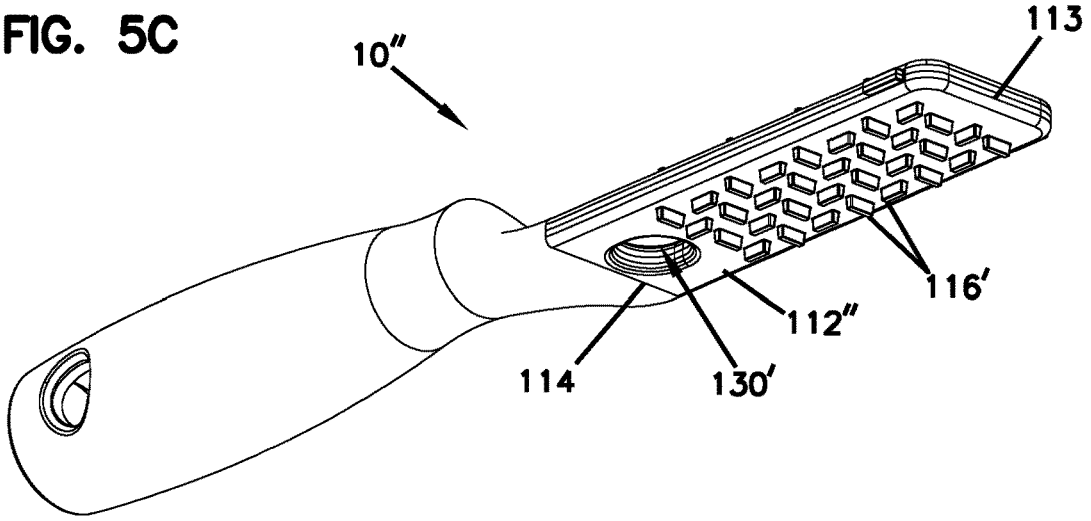
FIG. 5C is a perspective view of the shaft of the cleaning tool of FIG. 5A.
Figure 5D:
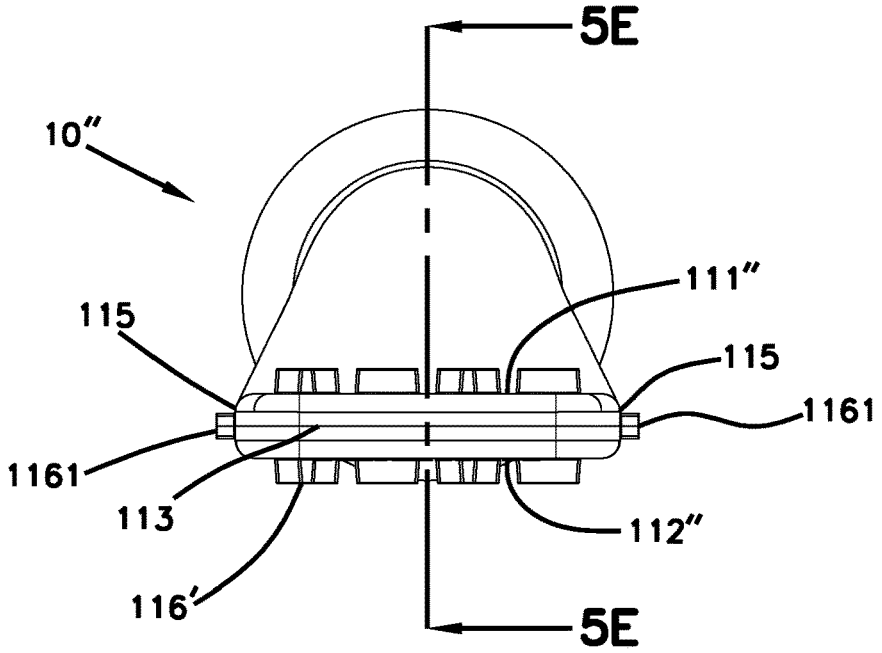
FIG. 5D is an end view of the shaft of the cleaning tool of FIG. 5A.
Figure 5E:
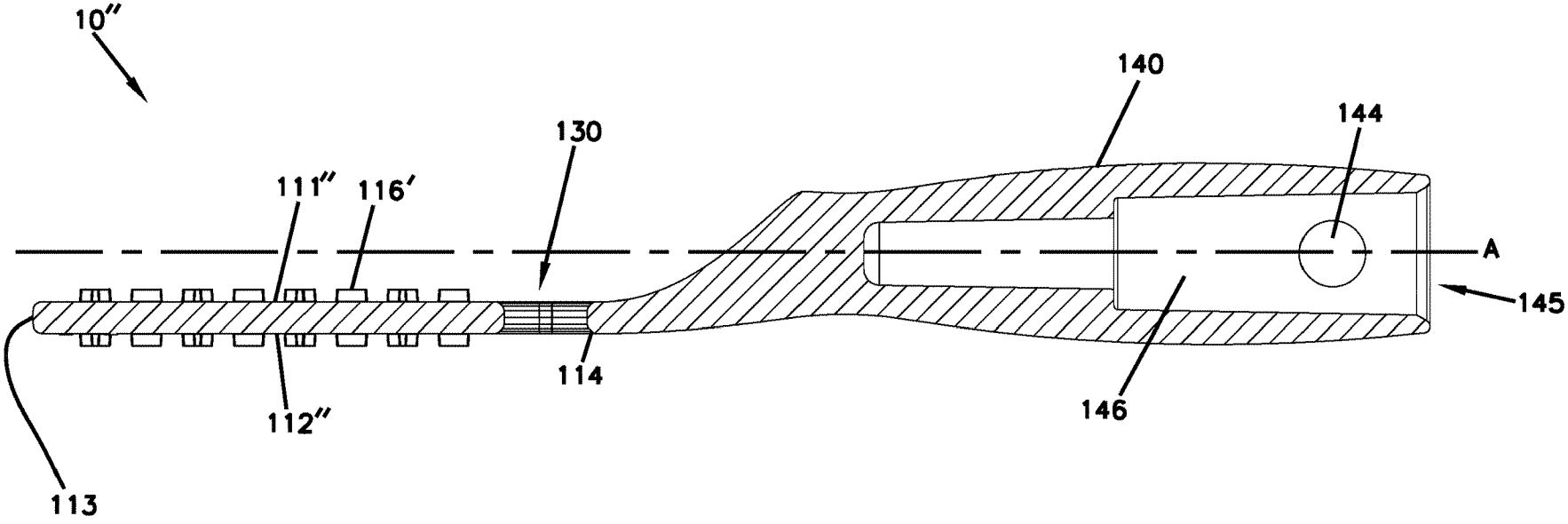
FIG. 5E is a cross sectional view of the shaft of the cleaning tool of FIG. 5A along cut A-A in FIG. 5D.

The tool head 110 may also include one or more laterally extending bumps 1161 that extend laterally from one or more of the lateral sides 115, as shown in FIGS. 5A-5C. The laterally extending bumps 1161 may be positioned adjacent the distal end of the tool head 110, or between the distal end of the tool head 110 and a midpoint on a longitudinal axis of the tool head 110. The laterally extending bumps 1161 may be similar in size and shape to the bumps 116 discussed above.

The sock 20 can be made of any suitable material or combination of materials to provide a desired cleaning surface. For example, the sock 20 can include a scrub pad, a scour pad, a sponge, a cloth, or a mop-style fringe. The material of the sock can include man-made materials, such as nylon, polypropylene, polyester, polyethylene, polyurethane, melamine foam, microfiber, or natural or modified materials like cotton, bamboo, agave, rayon, viscose, lyocell, wool, metal, etc. The material can be woven, knitted, or non-woven. In embodiments where the sock 20 includes a fringe, the material of the fringe may be independently selected from the same materials as the sock 20. The sock 20 or a portion of the sock 20 may also include inclusions to provide abrasion, such as silicate, silicon carbine, aluminum oxide, steel wool, etc. The abrasive portion may be provided for various grades of abrasion, including a scratching or non-scratching abrasive. To impart different levels of abrasion, various grades of abrasive materials can be employed. The abrasiveness of the material generally depends from the hardness and particle size of the abrasive. For example, a softer abrasive with a finer particle size can be used to produce a non-scratching pad, whereas a harder abrasive with a coarser particle size can be used to produce a rougher pad. Similarly, if the sock 20 includes steel wool, the steel wool can be fine or coarse depending on the desired abrasiveness. Steel wool is generally available as extra coarse (grade 4), coarse (grade 3), medium coarse (grade 2), medium (grade 1), medium fine (grade 0), fine (grade 00), extra fine (grade 000), and finest (grade 0000). The coarser grades are typically used for cleaning or removing material, whereas the finer grades can be used for buffing. In some embodiments, the sock 20 is made without metal parts to avoid scratching or damaging the surfaces being cleaned.

In some embodiments the sock 20 is constructed to be washable, e.g., by laundering the sock 20 in a laundry machine. In such embodiments, the sock 20 can be made without metal parts that could damage the laundry machine. In some embodiments, the sock 20 is intended to be used for a period of time and then discarded. In some further embodiments, the sock 20 is intended for one-time use.

The sock 20 can be reinforced with a second layer of material or with a layer of different material. For example, the sock 20 may include a reinforcement in the area where the fastener 30 is located. The sock 20 or a portion of the sock 20 may further include extensions, such as a fringe, scraper, wiping blade, or brush bristles.

The first side 21 and the second side 22 of the sock 20 can be similar or different from one another. For example, one of the sides can be constructed to have a rough or abrasive surface for scrubbing, and the other side to have a smoother or softer surface for wiping. The sock 20 can also include a rough or abrasive material on only a portion of one or both of the first and second sides 21, 22. For example, one or both sides may include a rough or abrasive material near the distal end 24 or near the proximal end 25 of the sock 20. In one example, the sock 20 comprises a scrub pad or scour pad made from a non-woven material, such as a polyester or polypropylene web. In another example, the sock 20 comprises a microfiber cloth or fringe. For example, the sock 20 may include a mop-like fringe 26 attached to the first and/or second sides 21, 22 and/or to the lateral sides of the sock, or any combination thereof. In yet another example, the sock 20 includes a brush.

The shaft 10 can be constructed of any suitable material of combination of materials. For example, the shaft 10 can be constructed of plastic (e.g., polypropylene, polyethylene, PVC, polyester, polyacrylic, nylon, etc.), rubber, metal, carbon fiber, wood, bamboo, etc., or a combination thereof. In one exemplary embodiment, the shaft 10 has an integral (i.e., one piece), molded plastic construction.

The handle 140 may have any suitable length or may be extendable. For example, the handle 140 may be constructed to be used as a short hand tool having a length of about 4-8 inches. The handle 140 can be constructed to fit into a user's hand, having a gripping portion 141 extending from the proximate end 12 to the transition portion 143, and may include a gripping surface and/or an ergonomic design at the gripping portion 141 of the handle 140.

Figure 4A:
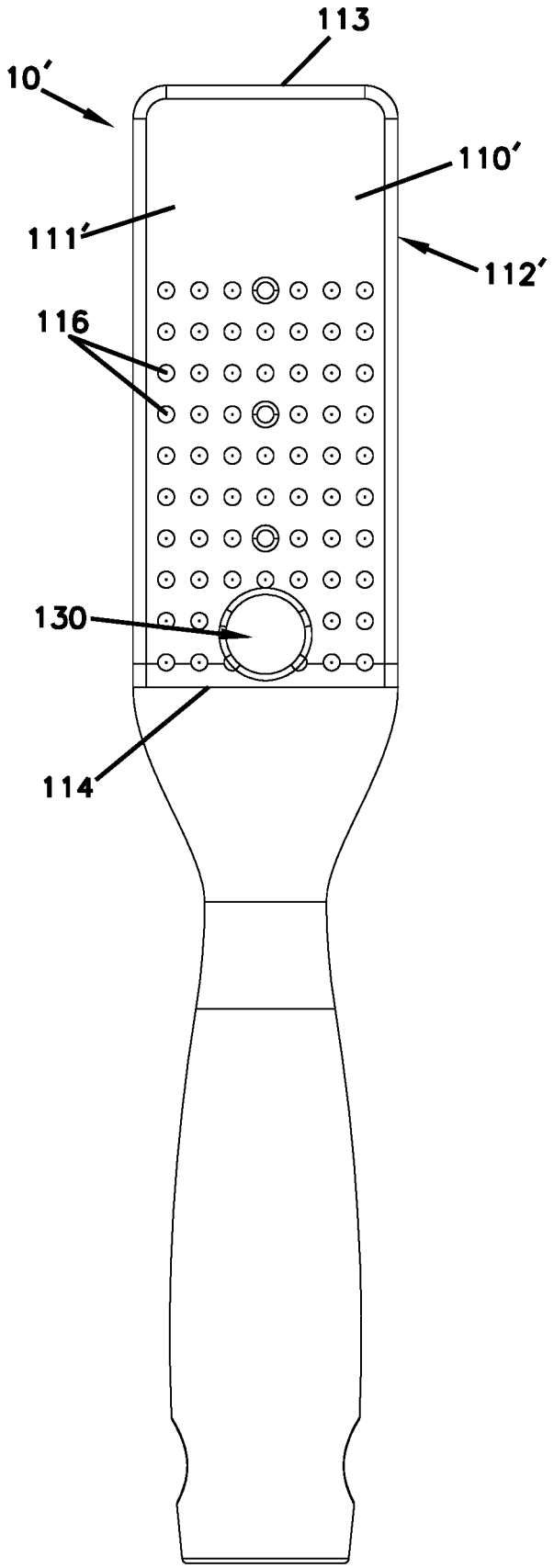
FIG. 4A is a front view of the shaft of a cleaning tool according to an embodiment.
Figure 4B:
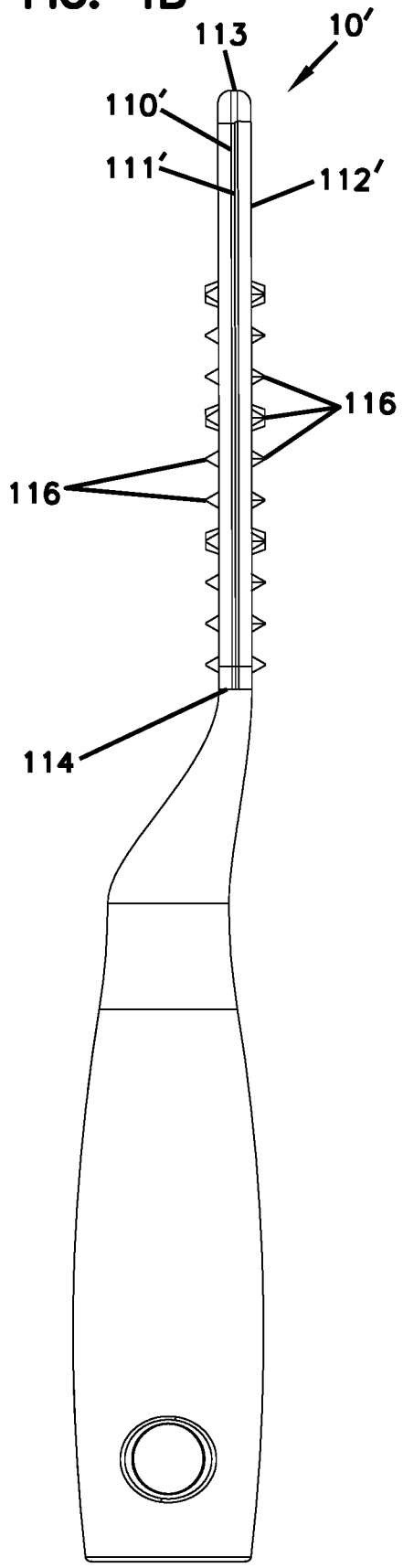
FIG. 4B is a side view of the shaft of the cleaning tool of FIG. 4A.
Figure 4C:
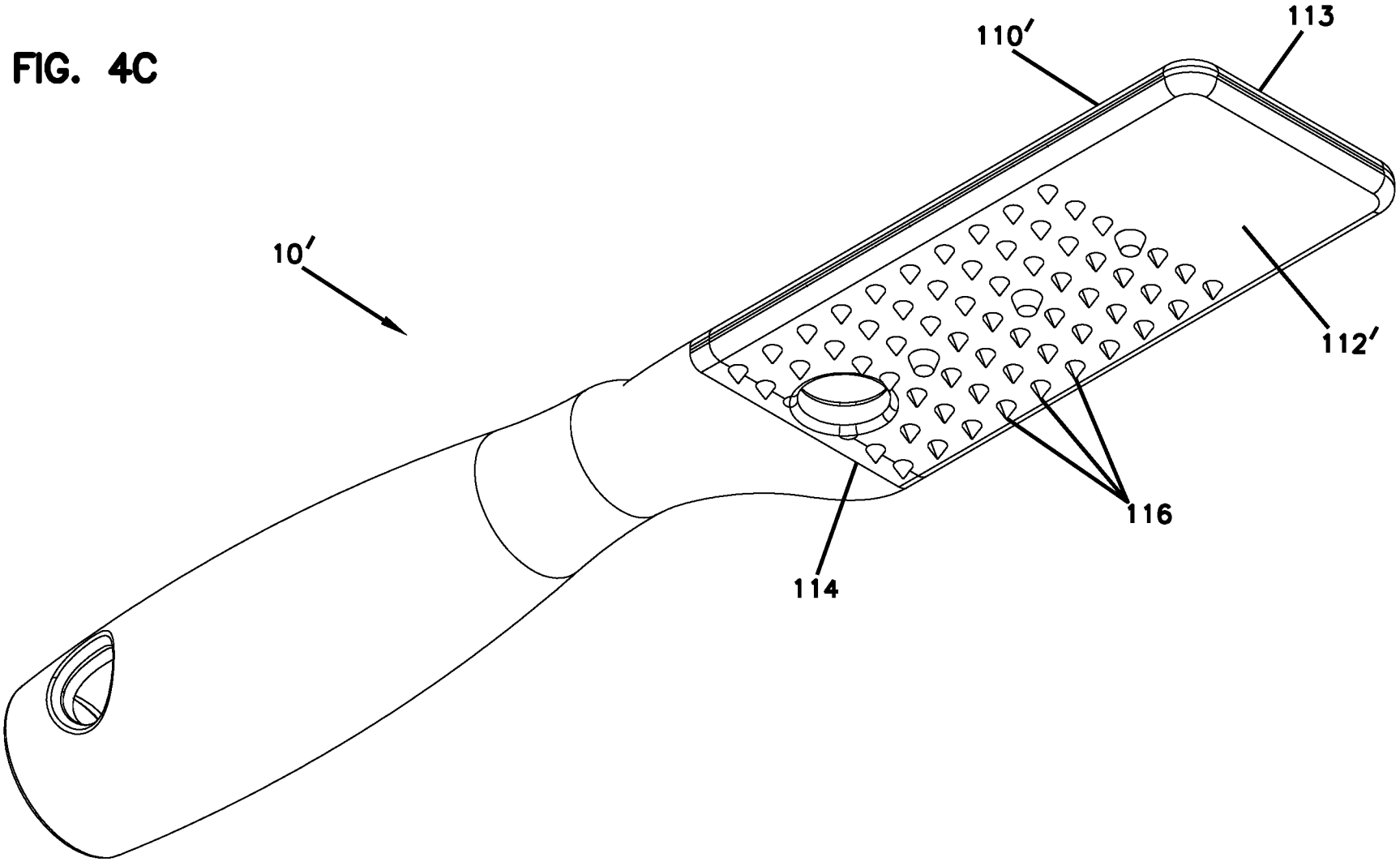
FIG. 4C is a perspective view of the shaft of the cleaning tool of FIG. 4A.
Figure 4D:
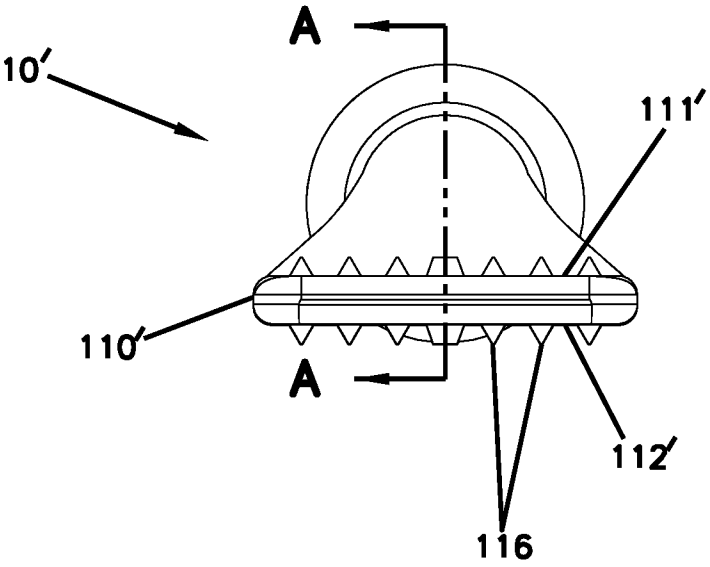
FIG. 4D is an end view of the shaft of the cleaning tool of FIG. 4A.
Figure 4E:
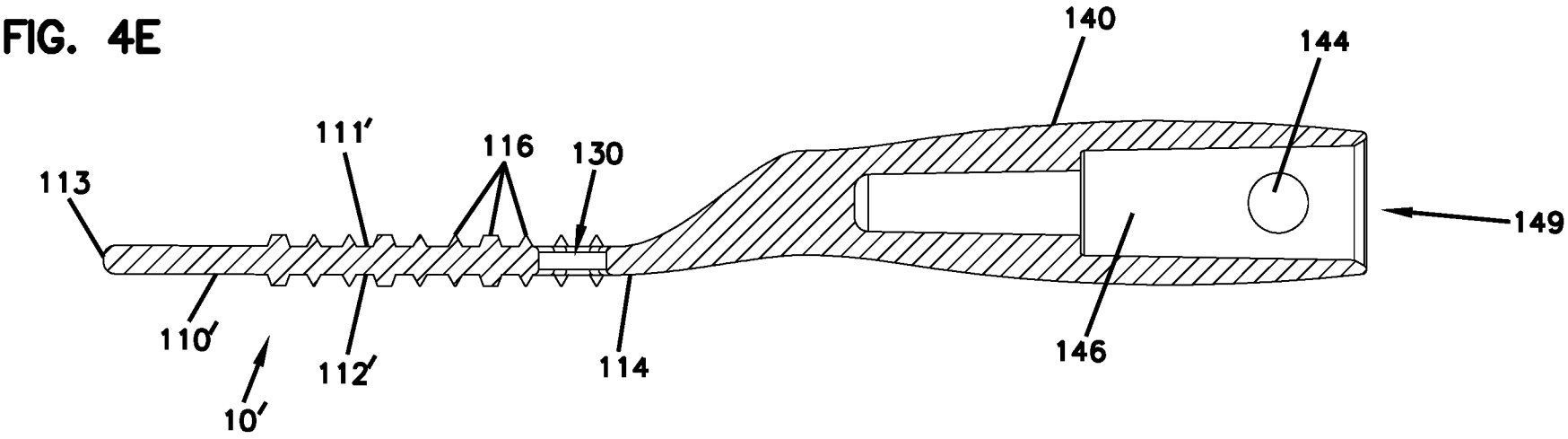
FIG. 4E is a cross sectional view of the shaft of the cleaning tool of FIG. 4A along cut A-A in FIG. 4D.
Figure 4F:
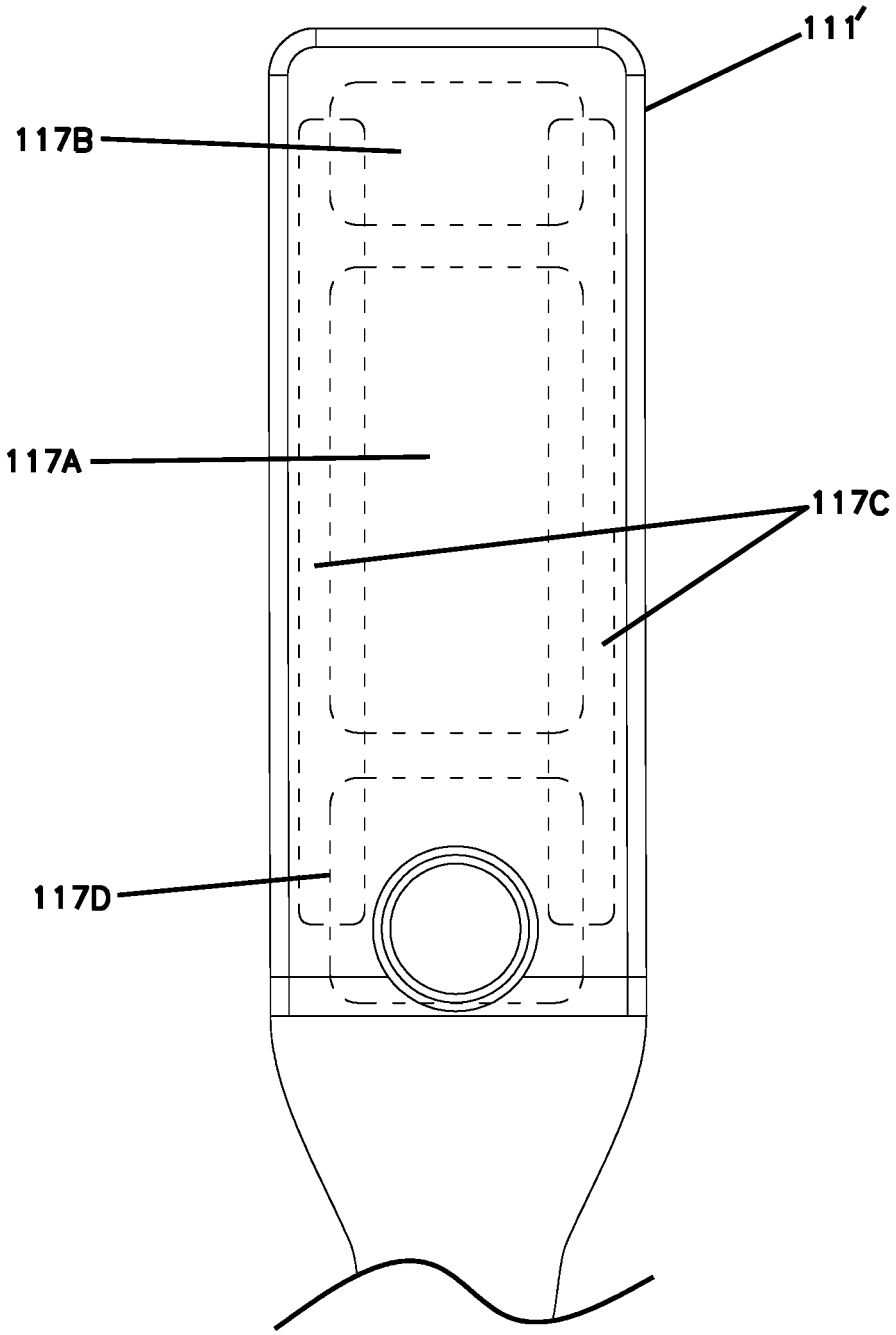
FIG. 4F is a schematic view of the tool head of the cleaning tool of FIG. 4A.

The handle 140 may also include a hollow center 146 accessible through an opening 145 at the proximal end 12 of the handle 140, as shown in FIG. 4E. The hollow center 146 may be constructed to accept an extension handle 180. The handle 140 may further include a mechanism 144 (such as holes 144*a*, 144*b*) for securing the extension handle 180 into place.

Figure 6A:
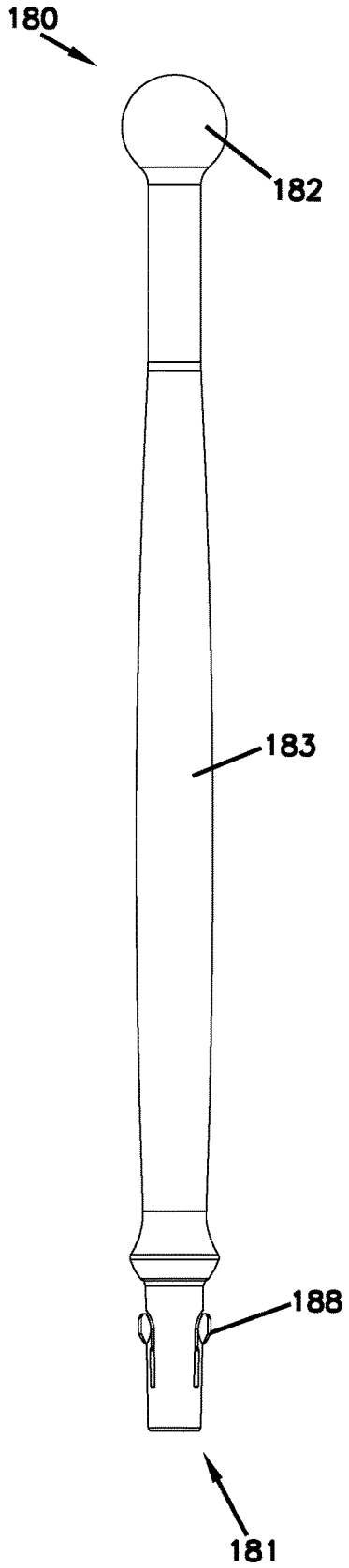
FIG. 6A is a front view of an extension handle of the cleaning tool of FIG. 1.
Figure 6B:
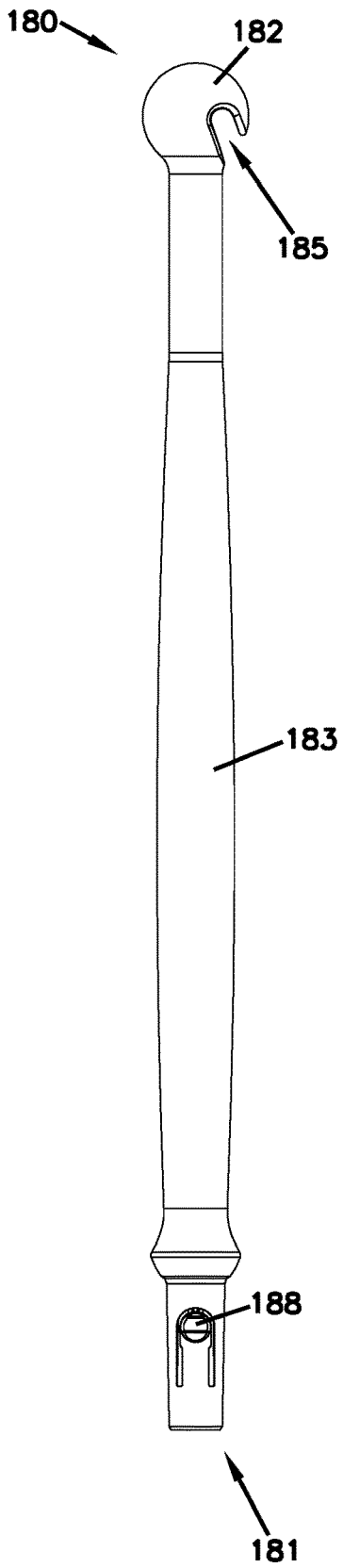
FIG. 6B is a back view of the extension handle of FIG. 6A.
Figure 6C:
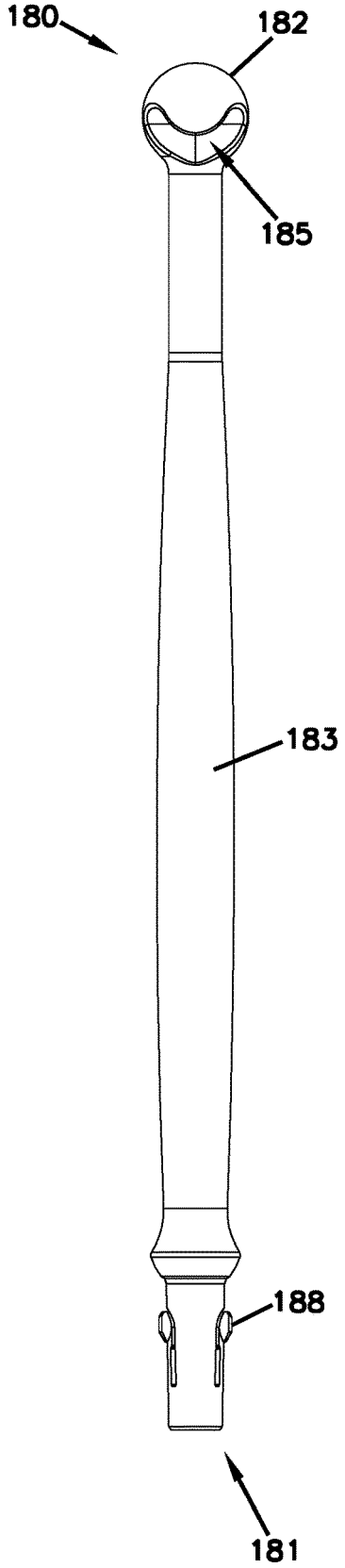
FIG. 6C is a side view of the extension handle of FIG. 6A.

An exemplary extension handle 180 is shown in FIGS. 6A-6C. The extension handle 180 can include a shaft 183 extending from a first end 181 to a second end 182, where the first end 181 can be constructed to be coaxially inserted into and received by the opening 145 at the proximal end 12 of the handle 140. The extension handle 180 may include a coupling mechanism 188 constructed to mate with the holes 144*a*, 144*b* on the handle 140. The second end may optionally include a hanging mechanism 185, such as a hook or a hole. The extension handle 180 can be made from the same material as the shaft 10 or from a different material. In one exemplary embodiment, the extension handle 180 has an integral, molded plastic construction.

According to an embodiment, the cleaning tool 1 is assembled by inserting the distal end 11 of the tool head 110 through the opening 28 at the proximal end of the sock 20. The sock 20 is slid onto the tool head 110 until the fastening mechanism 300 is aligned. For example, the sock 20 can be slid onto the tool head 110 until the first coupling member 31 and the second coupling member 32 are aligned with the through hole 130 on the tool head 110, and until the first and second coupling members 31, 32 can be couple with one another (e.g., pressed or snapped together). After the cleaning tool 1 is used for cleaning, the sock 20 can be removed by uncoupling the fastening mechanism 300 and pulling the sock 20 off the tool head 110. The sock 20 can be cleaned and reused, or can be disposed. The sock 20 can also be replaced with a different style cleaning sock. For example, a cloth or sponge sock for wiping can be replaced by a scouring pad.

The various embodiments and alternatives of the cleaning tool 1 discussed here can be included in any combination. In some embodiments, the cleaning tool 1 includes a shaft 10 with a handle 140 and a tool head 110 extending from a neck 142 and/or a transition portion 143 of the handle, and a removable sock 20. The handle 140 may have a round, semi-round, oval, oblong, square, rounded square, rectangle, or rounded (and/or flattened) rectangle transverse cross sectional shape. The neck 142 may comprise a narrowing portion of the handle 140. The transition portion 143 may be a funnel-like portion. The tool head 110 may be generally coaxially aligned with the central longitudinal axis A of the handle 140, or may be offset from the axis A by at least about 0.2 or 0.3 inches and up to about 3 inches, 2 inches, 1 inch, 0.75 inches, or about 0.5 inches. One or both of the flat surfaces of the tool head 110 may be parallel to the central axis A, or the tool head 110 may be disposed in an angle relative to the central axis A, or may be curved. The tool head 110 may have an approximately rectangular shape, or may be oblong, oval, triangular, square, etc., and have a generally flat transverse cross section. The tool head 110 may have a length L110 of about 2 to about 12 inches, about 2.5 to about 10 inches, or about 3 to about 8 inches, and a width W110 of about 0.5 to about 2.5 inches, about 1.0 to about 2.25 inches, about 1.25 to about 2.0 inches, about ¾ to about 6 inches, about 1 to about 4 inches, or about 1.25 to about 3 inches. A tube-like or pocket-like sock 20 is provided to be mounted on the tool head 110. The sock 20 may be provided with slits 27 or partial openings extending about 10%, about 15%, about 20%, about 25%, or up to about 50% of the length L20 of the sock 20 from the proximal end 25. The sock 20 can include a scrub pad, a scour pad, a sponge, a cloth, or a mop-style fringe, and can be made of man-made materials, such as nylon, polypropylene, polyester, polyethylene, polyurethane, melamine foam, microfiber, or natural or modified materials like cotton, bamboo, agave, rayon, viscose, lyocell, wool, metal, etc. The material can be woven, knitted, or non-woven, and can be washable or disposable. The sock 20 or a portion of the sock 20 may also include inclusions to provide abrasion, such as silicate, silicon carbine, aluminum oxide, steel wool, etc. The sock 20 or a portion of the sock 20 may include extensions, such as a fringe, scraper, wiping blade, or brush bristles, and may be reinforced, for example, in the area where the fastener 30 is located. The first side 21 and the second side 22 of the sock 20 can be similar or different from one another. The tool head 110 and the sock 20 can include one or more fastening mechanisms 300 to retain the sock 20 on the tool head 110. The fastening mechanism 300 can comprise at least one fastener 30 on the sock, and may include first and second coupling members 31, 32, constructed to be coupled with each other, or with a coupling member on the tool head. The fastener 30 can comprise a snap closure, a hook-and-loop closure, a latch, a clasp, a button closure, or a magnetic closure. The first coupling member 31 can be positioned on the first side 21 of the sock 20, and the second coupling member 32 on the second side 22. The tool head 110 may include a through hole 130 that facilitates coupling of the first and second coupling members 31, 32. The fastening mechanism(s) 300 could be positioned at different locations, such as centered, off center, on both sides of the center, further away from the proximal end 25, or on or around the handle 140, transition portion 143, or the neck 142. The tool head 110 can include a roughened surface positioned on both sides of the tool head 110, or on one side only, or in a limited area, such as in the center area 117A only, in the distal area 117B only, on the sides 117C only, in the proximal area 117D only, or any combination thereof. The bumps 116 of the roughened surface can be conical or pyramid-shaped having a cross diameter of about 0.5 to about 4 mm, about 1 to about 3 mm, or about 1.5 to about 2.5 mm, or rectangular having a length of about 2 to about 12 mm, or about 4 to 8 mm, a width of about 0.5 to about 4 mm, and a height of about 0.5 to about 4 mm, about 1 to about 3 mm, or about 1.5 to about 2.5 mm. The tool head 110 may also include one or more laterally extending bumps 1161. The shaft 10 can be constructed of plastic (e.g., polypropylene, polyethylene, PVC, polyester, polyacrylic, nylon, etc.), rubber, metal, carbon fiber, wood, bamboo, etc., or a combination thereof. The handle 140 may have any suitable length, e.g., about 4-8 inches, or may be extendable. The handle 140 may also include a hollow center 146 for coupling with an extension handle.

EXAMPLES

Various embodiments of the cleaning tool were constructed. In each instance, the shaft of the cleaning tool was constructed from molded plastic.

Example 1A

Figure 7:
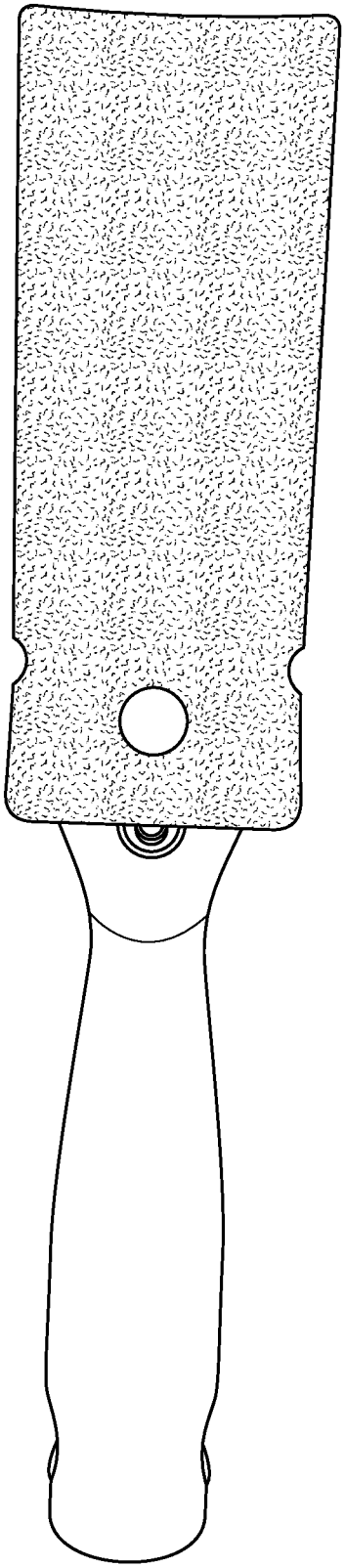
FIG. 7 is a photograph of an exemplary cleaning tool according to an embodiment.

A cleaning tool was constructed with a sock constructed from a polymer scrub pad material for high temperature applications. The sock included a slit extending on each side of the sock about 1 inch from the proximal end of the sock. The sock was provided with a snap button, and a corresponding mating portion of the snap button was provided on the shaft. The cleaning tool is shown in FIG. 7.

Example 1B

Figure 8A:
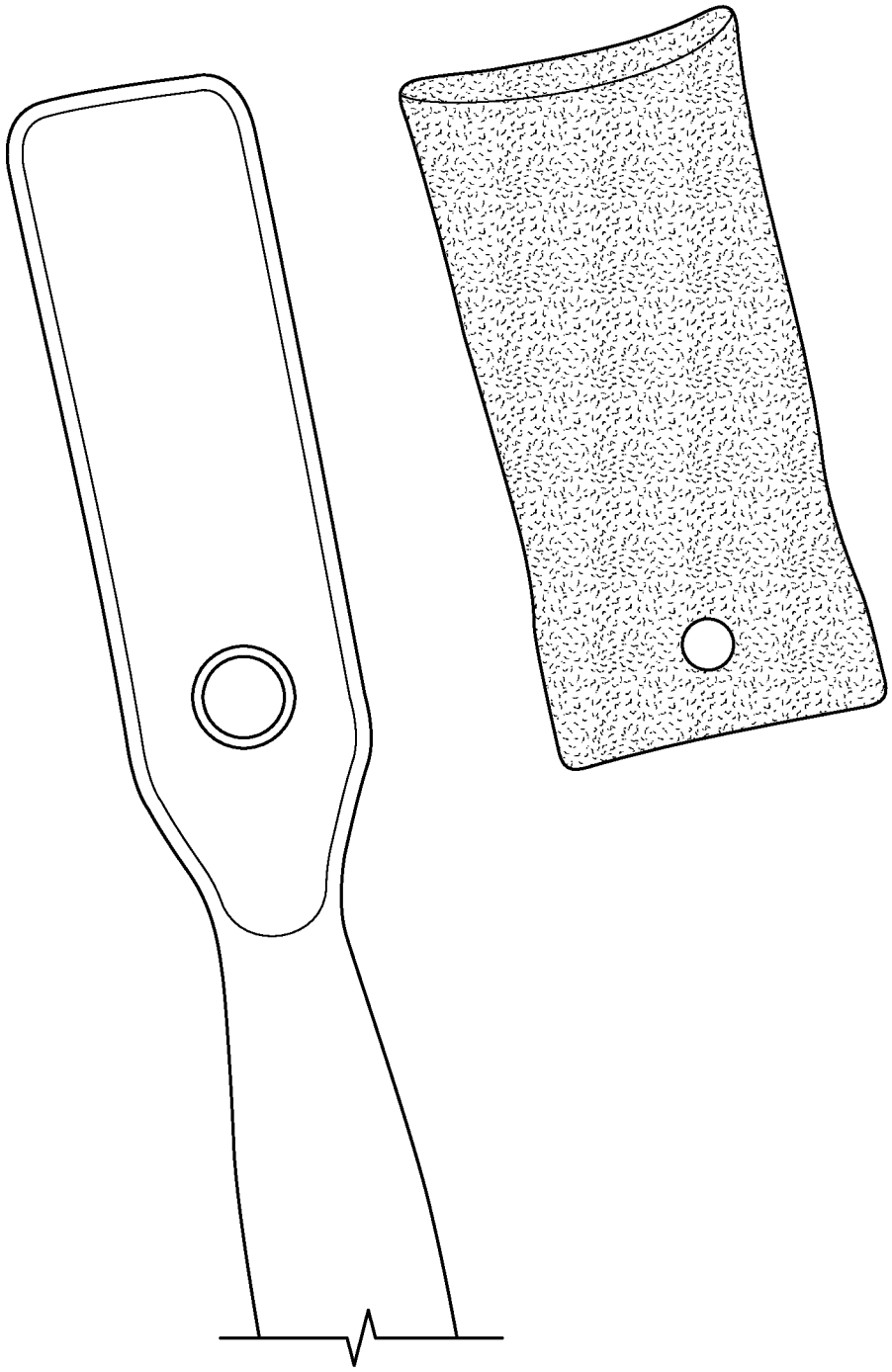
FIGS. 8A and 8B are photographs of an exemplary cleaning tool according to an embodiment.
Figure 8B:
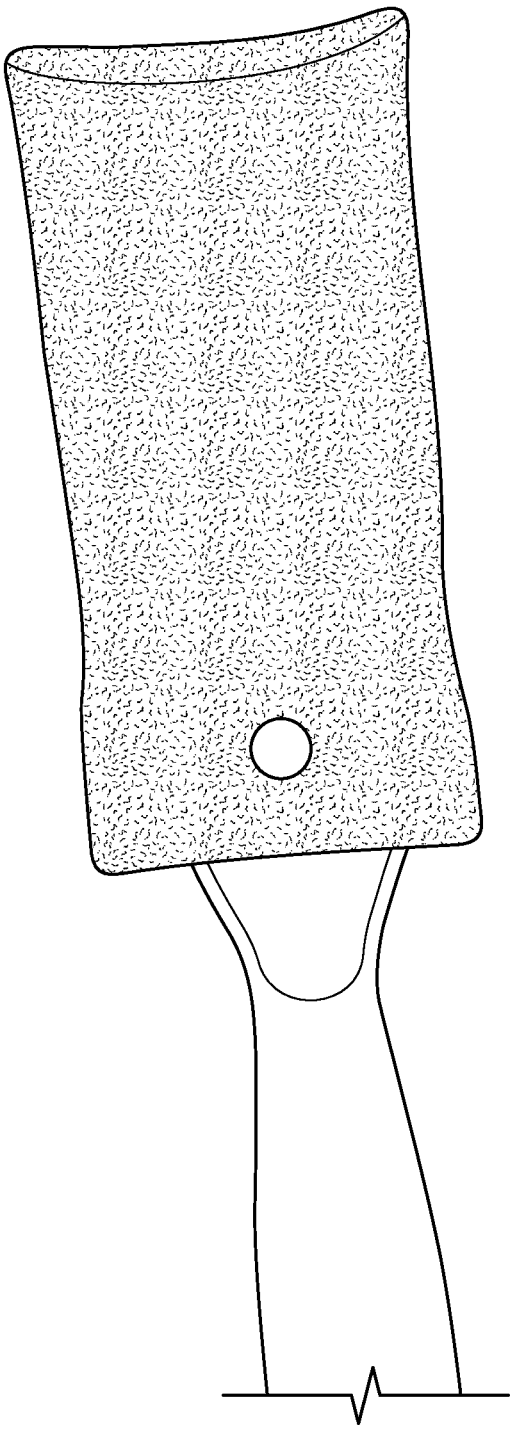

The sock was constructed as in Example 1A. The shaft was constructed with a through hole in the tool head. The sock was provided with a snap button that could be aligned with and coupled through the hole in the tool head. The cleaning tool is shown in FIGS. 8A and 8B.

Example 2

Figure 9A:
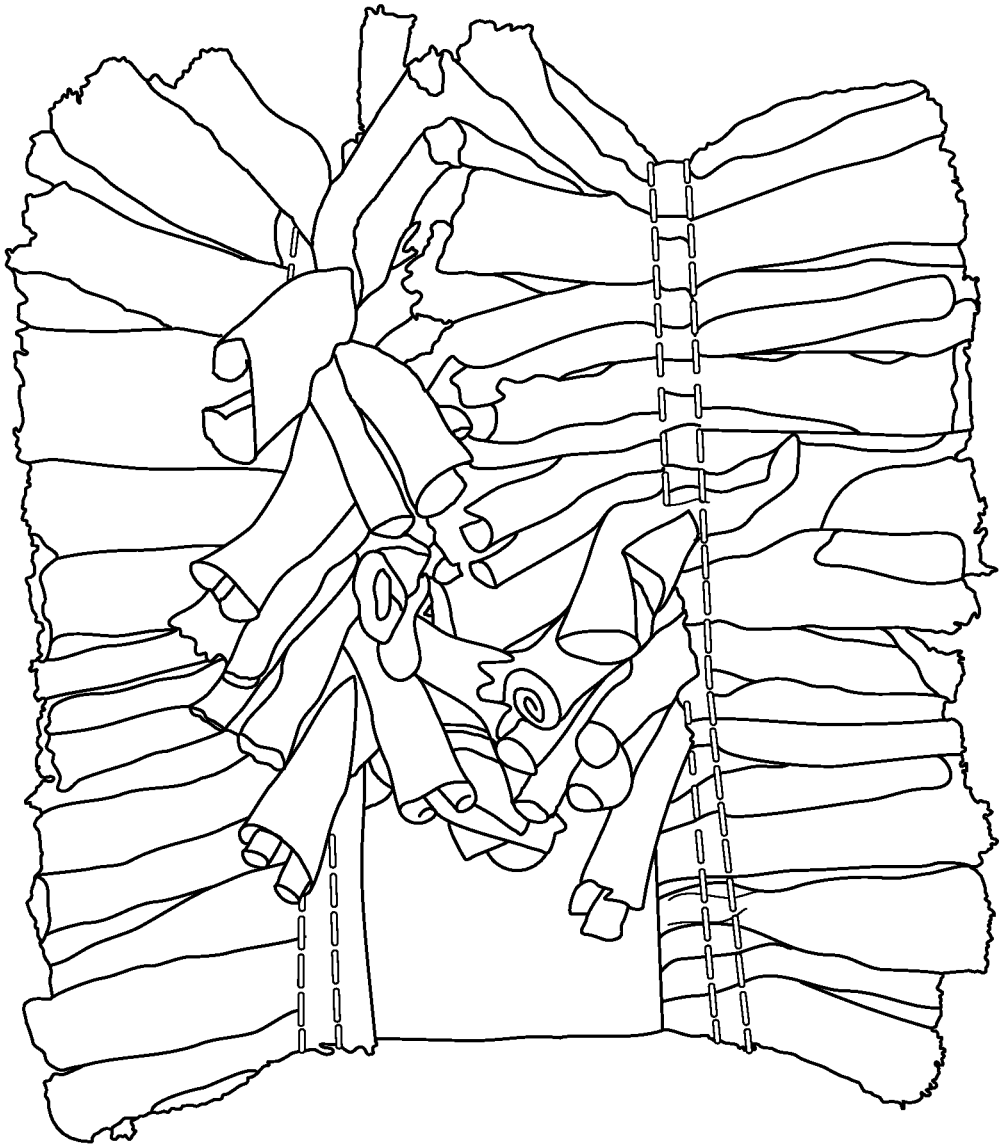
FIGS. 9A and 9B are photographs of an exemplary cleaning tool sock and shaft according to an embodiment.
Figure 9B:
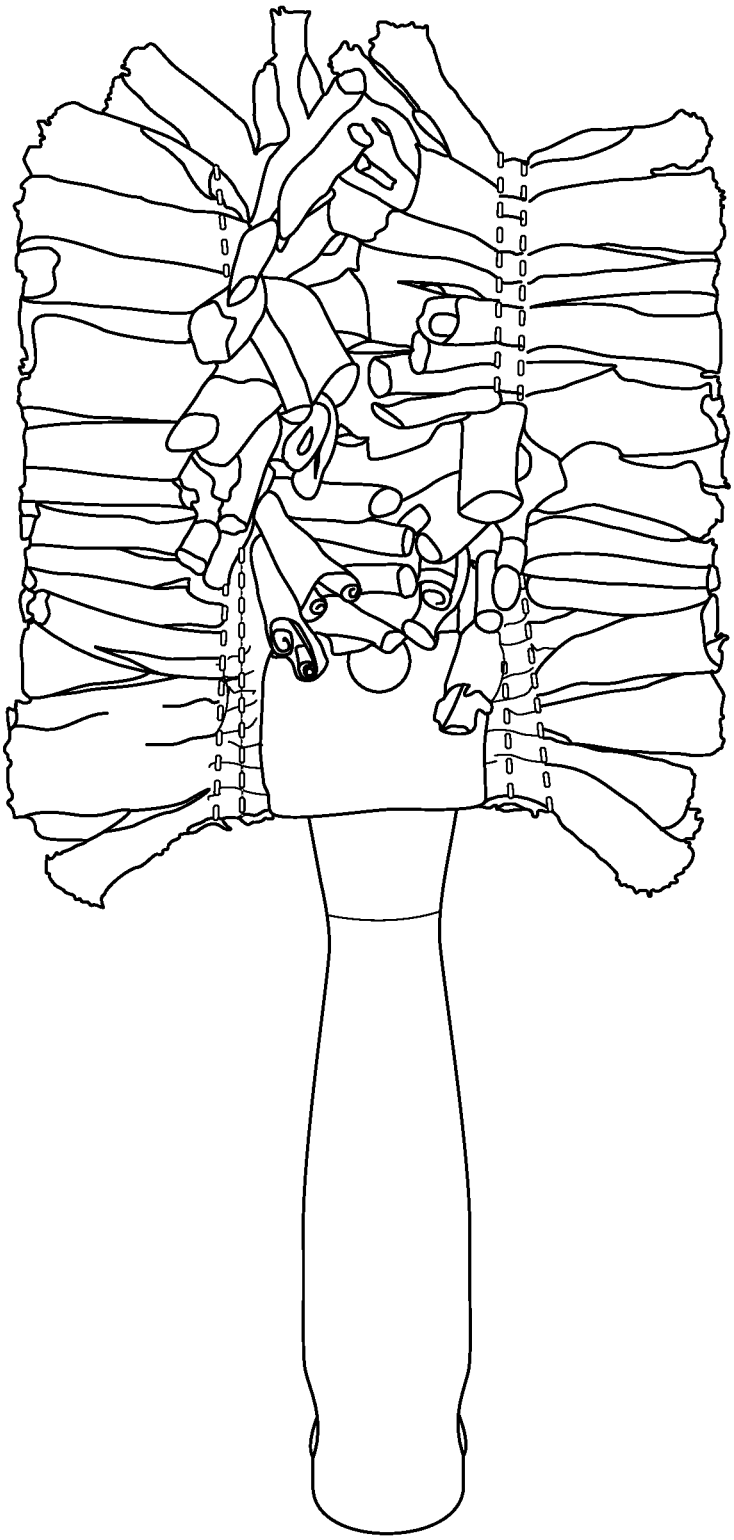

A cleaning tool was constructed with a sock constructed with woven base layer and a fringe attached to the outside of the base layer on both the first side and the second side. The sock was provided with a snap button closure, where the first half of the snap button was placed on the first side of the sock and the second half of the snap button on the second side of the sock. The sock is shown in FIG. 9A, and mounted on a shaft in FIG. 9B.

While certain embodiments of the invention have been described, other embodiments may exist. While the specification includes a detailed description, the invention's scope is indicated by the following claims. The specific features and acts described above are disclosed as illustrative aspects and embodiments of the invention. Various other aspects, embodiments, modifications, and equivalents thereof which, after reading the description herein, may suggest themselves to one of ordinary skill in the art without departing from the spirit of the present invention or the scope of the claimed subject matter.

What is claimed is:

1. A cleaning tool comprising:

(a) a shaft extending from a proximal end to a distal end, the shaft comprising a handle at the proximal end and a tool head at the distal end, the tool head comprising first and second major sides extending longitudinally from the handle; and (b) a sock removably mountable on the tool head, the sock comprising a pocket with an opening for inserting the tool head, wherein the tool head comprises a through hole, and the sock comprises a fastener comprising a first coupling member and a second coupling member, and wherein the first and second coupling members are constructed to align with and couple through the through hole on the tool head.

2. The cleaning tool of claim 1, wherein the fastener comprises a snap button.

3. The cleaning tool of claim 1, wherein the fastener comprises a hook and loop fastener.

4. The cleaning tool of claim 1, wherein the sock comprises a scour pad or a scrub pad.

5. The cleaning tool of claim 1, wherein the sock comprises a mop fringe.

6. The cleaning tool of claim 5, wherein the pocket comprises a first material and the mop fringe comprises a second material.

7. The cleaning tool of claim 1, wherein the shaft has a center axis, and wherein the tool head is disposed in a plane that is offset from the center axis.

8. The cleaning tool of claim 1, wherein the shaft is extendable.

9. The cleaning tool of claim 8, wherein the shaft comprises a hollow center, and wherein the cleaning tool further comprises comprising an extension handle that can be coupled with the hollow center of the shaft.

10. The cleaning tool of claim 1, wherein the first and second major sides of the shaft are positioned parallel to and offset from a longitudinal axis of the shaft.

11. The cleaning tool of claim 1, wherein the tool head comprises a plurality of through holes and the sock comprises a plurality of corresponding fasteners.

12. The cleaning tool of claim 1, wherein the tool head comprises first and second minor sides extending parallel to the first and second major sides, and one or more bumps extending laterally from one or both of the first and second minor sides, wherein the bumps are constructed to provide friction for the sock.

* * * * *